United States Patent [19]

Benzon

[11] 4,090,956

[45] May 23, 1978

[54] HYDROCYCLONE

[75] Inventor: William Benzon, Center Valley, Pa.

[73] Assignee: Wilmot Engineering Co., White Haven, Pa.

[21] Appl. No.: 720,075

[22] Filed: Sep. 2, 1976

[51] Int. Cl.[2] ..... B04C 5/12; B04C 5/14

[52] U.S. Cl. ..... 209/211; 210/512 R

[58] Field of Search ..... 210/84, 512; 209/211, 209/144

[56] References Cited

U.S. PATENT DOCUMENTS

| | | | |
|---|---|---|---|
| 2,724,503 | 11/1955 | Fontein | 209/211 |
| 2,779,469 | 1/1957 | Harris | 209/211 |
| 2,819,795 | 1/1958 | Fontein et al. | 209/211 |
| 3,136,723 | 6/1964 | Erwin et al. | 210/512 R |
| 3,366,247 | 1/1968 | Visman | 210/512 M |
| 3,370,408 | 2/1968 | Lehrer et al. | 210/512 R |
| 3,386,588 | 6/1968 | Ades | 209/211 |
| 3,389,793 | 6/1968 | Leeman | 209/211 |

FOREIGN PATENT DOCUMENTS

| | | | |
|---|---|---|---|
| 1,037,980 | 9/1953 | France | 209/211 |
| 608,026 | 9/1948 | United Kingdom | 209/211 |
| 893,764 | 4/1962 | United Kingdom | 210/512 |

*Primary Examiner*—Frank W. Lutter
*Assistant Examiner*—Jon Hokanson
*Attorney, Agent, or Firm*—Clarence A. O'Brien; Harvey B. Jacobson

[57] ABSTRACT

A hydrocyclone having a primary vessel with multiple inputs, a removable wide mouth top provided with a splash shield and adjustable atmospheric pipe, and quick open-close clamps for making the top quickly removable from and reattachable to the hydrocyclone vessel. A removable apex cone together with changeable wear plate is provided for the outlet and operating opening of the hydrocyclone. A removable vortex finder is also provided together with adjustable holddown rods provided on the top cover plate for maintaining the vortex finder in proper position within the vessel.

8 Claims, 7 Drawing Figures

Fig. 1
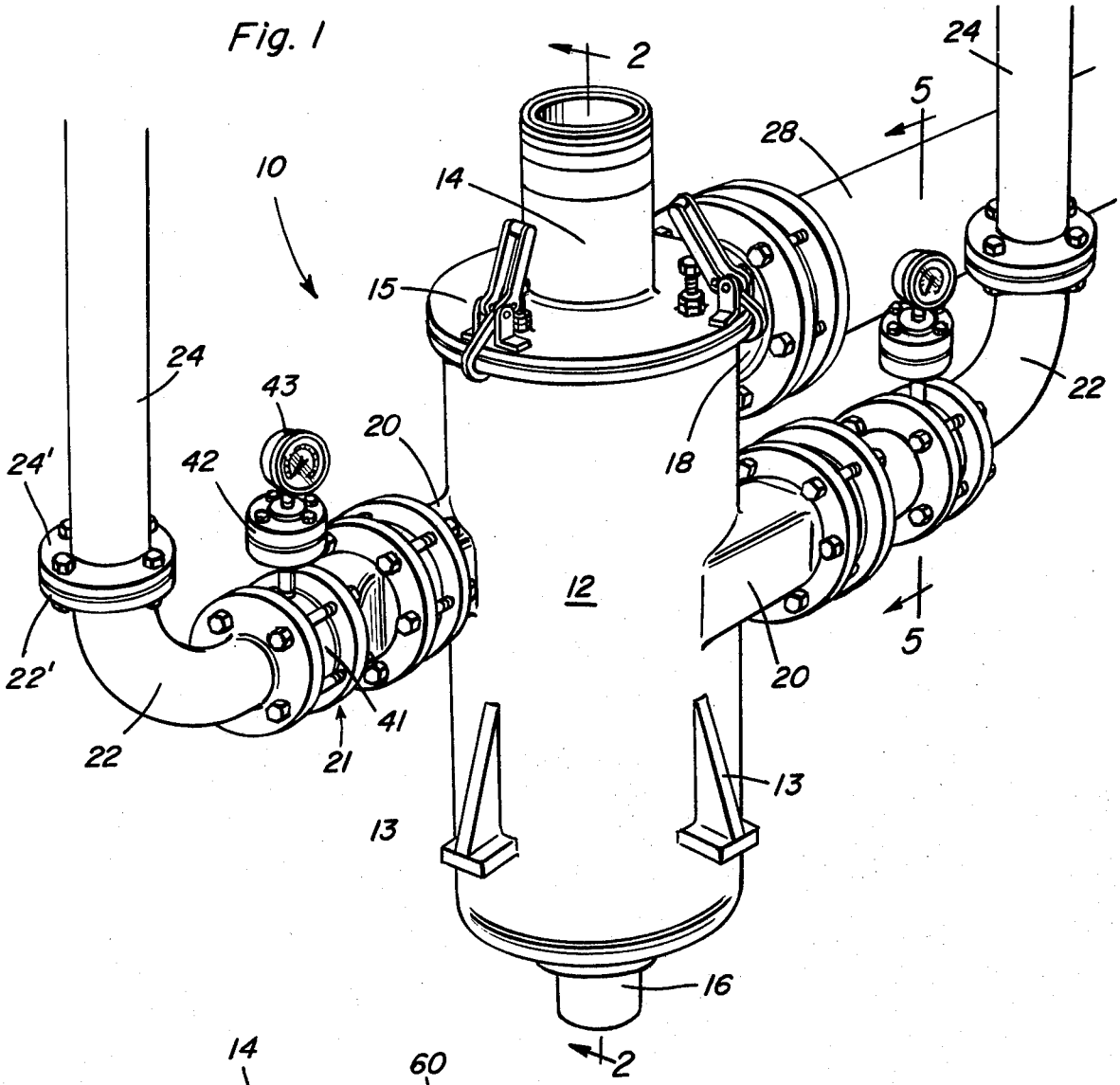
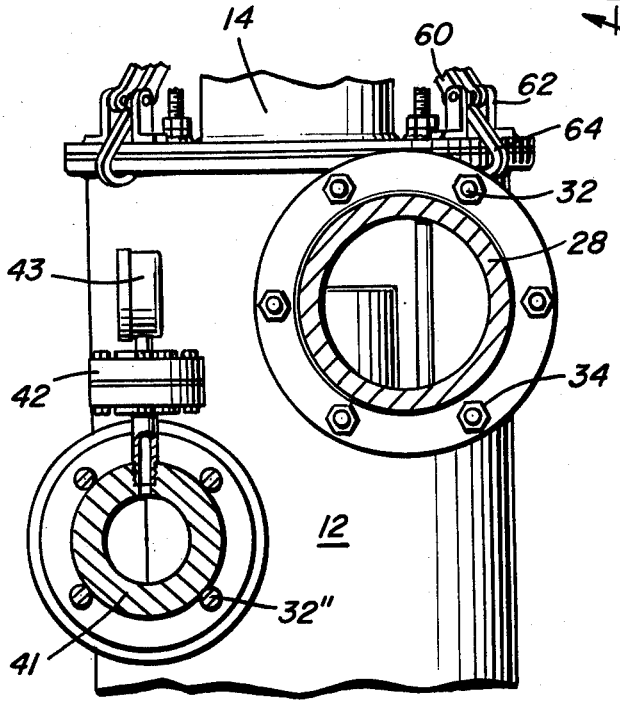
Fig. 5

Fig. 2
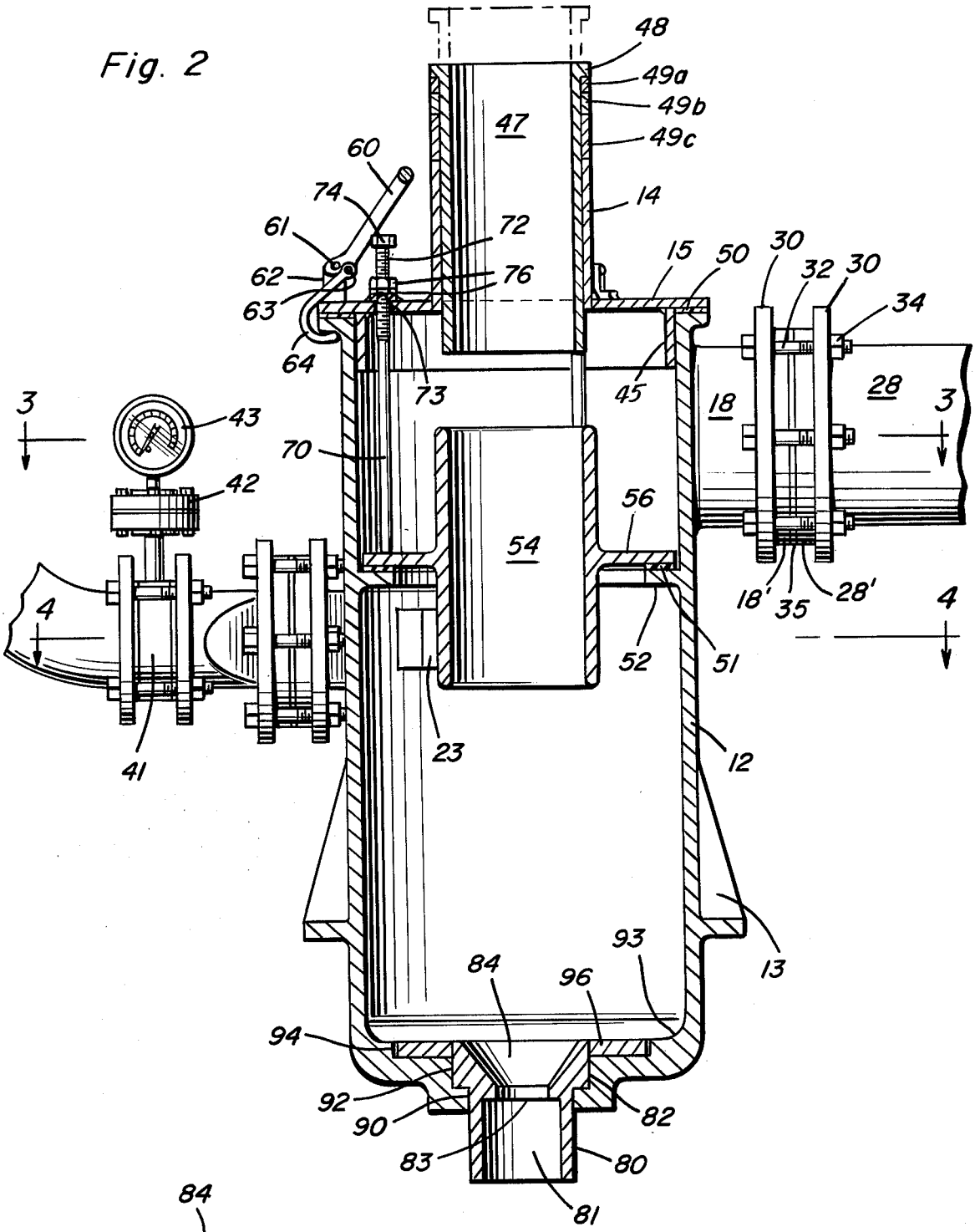
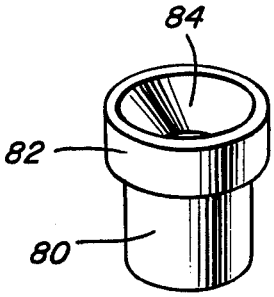
Fig. 6

Fig. 3
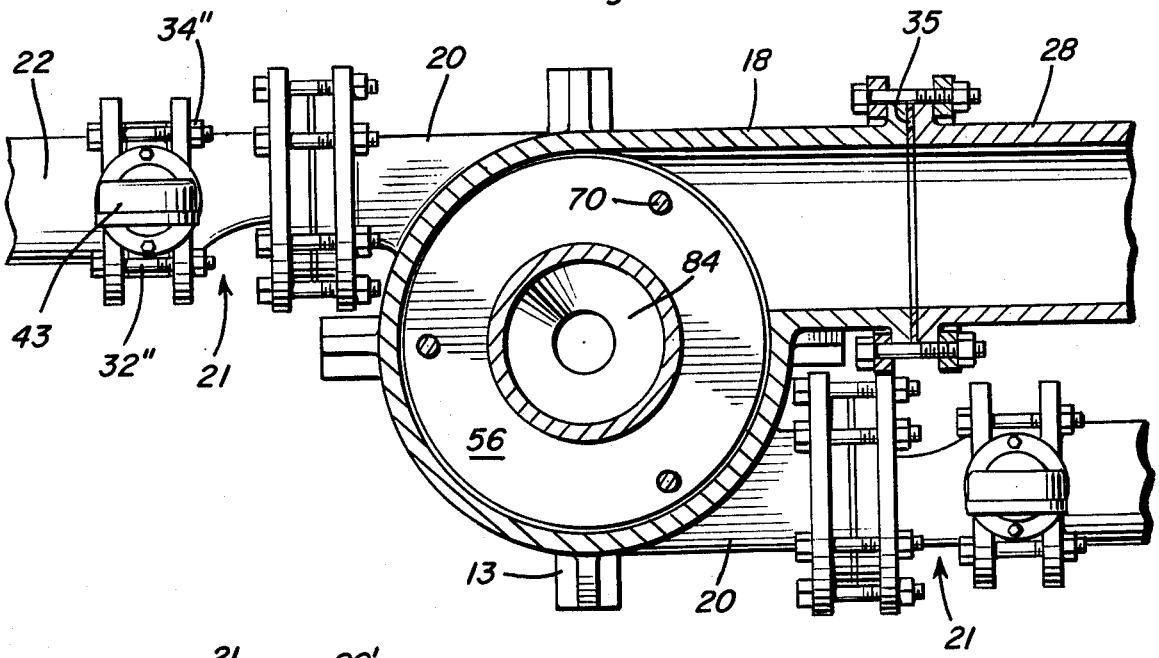
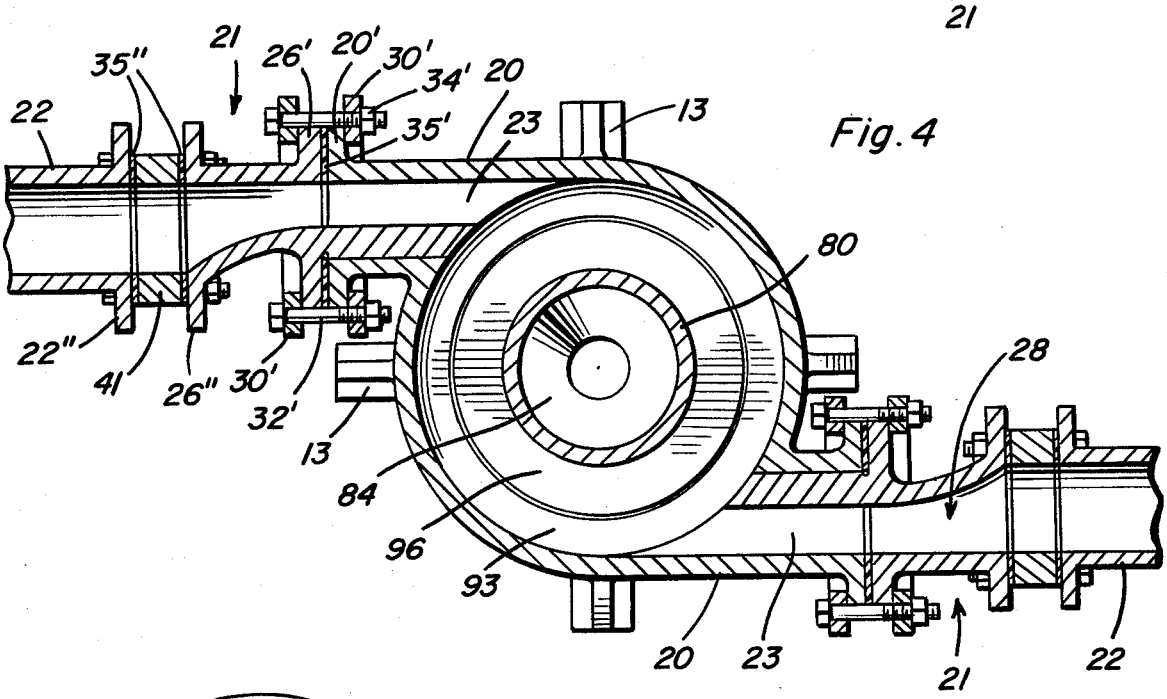
Fig. 4
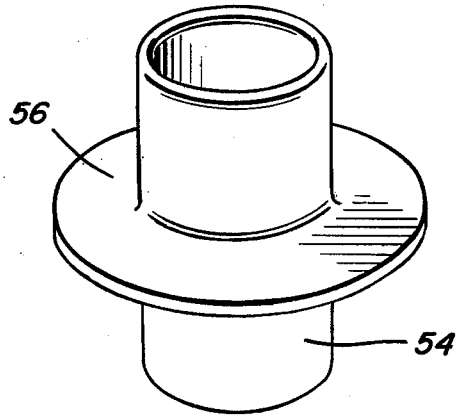
Fig. 7

HYDROCYCLONE

BACKGROUND OF THE INVENTION

1. Field of the Invention

The present invention relates to hydrocyclone devices which will separate desirable particles from undesired ones in a better and more efficient manner.

2. Description of the Prior Art

A problem with known type hydrocyclone type devices is that they are not open at the top for ready access to the interior thereof for either replacement of components therein or change in size and arrangement of same.

Another problem with known type devices is that the discharge opening normally provided at the bottom of the overall vessel of the device does not have a replaceable or changeable member, nor are they generally provided with hard, wear resilient type replaceable plates.

Another problem with known type devices is that the vortex finder as generally used is not mounted in a manner which enables quick and easy replacement of the vortex finder.

Another problem with known type devices is that they are provided with a single inlet for the slurry or mix to be separated and as such an elliptical cyclone type path is formed within the vessel rather than a completely circular one. Such a structure does not permit as fine a cut or separation of the particles as desired.

SUMMARY OF THE INVENTION

An object of the present invention is to provide a hydrocyclone device having multiple inputs for the slurry containing the desired as well as undesired particles.

Another object of the present invention is to provide a hydrocyclone device having a replaceable apex cone mounted at the bottom outlet thereof. Said apex cone may be quickly and easily replaced, together with a replaceable wear plate surrounding same, whenever one or the other become worn or distorted due to wear.

Another object of the present invention is to provide a hydrocyclone device having an open wide mouth top with a removable and replaceable cover member. The cover member has splash plate and atmospheric pipe structure for preventing any of the material contained within the device from being splashed or thrown outwardly of same.

An additional further object of the present invention is to provide adjustable holddown rods together with the replaceable top cover for retention and holding of the vortex finder within the vessel for proper operation of same. The adjustable holddown rods permit quick and easy removal and replacement of the vortex finder merely by lifting the top cover member. The top cover member is secured by quick holddown type clamps to also permit quick and easy removal and replacement.

The hydrocyclone device of this invention is primarily for washing and separation of desired from undesired particles, but is not strictly for size classification. A number of new features are provided herein such as multiple inputs for the slurry of input material, a removable and replaceable apex cone, and an open top which is fitted with an adjustable atmospheric pipe and splash shield. A number of desirable results are achieved by the use of the plurality of inputs, shown in the illustrations as being two in number. However, this is for illustration only and a number of inputs more than two is envisioned and included in the scope of this invention. With the multiple inputs, less pressure is required to feed a given amount of slurry. This is important when the cyclone is to be gravity fed since less head room is required.

The multiple inputs also result in uniform wear on the conical reject discharge section, the apex cone. When only one input is employed, the rejects travel about 270° beyond the inlet and are all discharged at one point, resulting in early wear at this point only, thus changing the character of the separation and reducing the life of the apex cone. When two or more inlets are employed, the rejects are discharged uniformly around the circumference of the apex cone, maintaining the desired separation characteristics, and increasing the life of the apex cone.

The multiple inputs also result in a sharper cut between overflow and underflow products. It has been observed that, with a single inlet, the rotating air core was not circular in cross section but was elliptical. Since the vortex finder, which cuts out the overflow, is circular in section, it will make a more precise cut if the rotating mass has a circular section at the cut point. Providing two or more inlets insures a rotating core that is circular.

Also, by using multiple inlets as designed with coupling structure, the separating characteristics of the cyclone can be changed by changing the inner diameter of the coupling structure and regulating the inlet pressure to restore the same feed rate. Making the inner diameter of the coupling structure smaller results in increasing the inlet velocity which, in turn, changes the separating gravity.

Another important feature of this device is the removable and replaceable open top with splash shield. This open top permits the quick and easy removal and replacement of the vortex finder and the apex plug without dismantling the cyclone itself.

Another feature of the open top structure is that it permits insertion and adjustment of the splash shield. It has been observed that some of the overflow is thrown back into the air core and falls out with the reject, resulting in loss of desired product. The shield can be adjusted to prevent this.

A further important feature of this invention is the apex cone which can be turned or replaced very quickly and easily in conjunction with the open top with no need to dismantle the cyclone in order to do this.

Another important feature of the apex cone is that the washing characteristics of this cyclone can be changed quickly simply by inserting an apex cone with a different cone angle. This can be done without shutting down the plant when multiple units are required. The units can be fitted with feed shutoff valves, and one unit at a time can be changed without shutting down the entire plant. Also, a wear plate is provided associated with the apex cone which can also be quickly and easily changed. An additional feature is that the washing characteristics of the cyclone can be changed by raising or lowering the cone by means of shims.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the hydrocyclone device of this invention.

FIG. 2 is a side elevational view, partly in cross section, taken generally along line 2—2 of FIG. 1.

FIG. 3 is a top plan view, partly in cross section, taken generally along line 3—3 of FIG. 2.

FIG. 4 is a top plan view, partly in cross section, taken generally along line 4—4 of FIG. 2.

FIG. 5 is an end elevational view, partly in cross section, taken generally along line 5—5 of FIG. 1.

FIG. 6 is a perspective view of the apex plug insert per se.

FIG. 7 is a perspective view of the vortex finder per se.

DESCRIPTION OF THE PREFERRED EMBODIMENT

Referring to FIG. 1 of the drawings, reference numeral 10 represents in general the hydrocyclone device of this invention. A primary vessel member 12 is provided having appropriate support structure 13 thereon. An adjustable tubular pipe member 14 is provided on the removable top 15. A discharge opening 16 for undesired particle is provided at the bottom of the vessel. Multiple inlet ports 20 are appropriately formed on the mid-section walls of the vessel as shown. A flow outlet 18 connected to the outlet pipe 28 is also provided. The multiple inlet ports 20 are each appropriately connected by coupling structure 21, to be described in detail below, and in turn connected to input ell 22 and slurry input feed pipe 24. Looking at the side view of FIG. 2, the coupling between the float outlet 18 and the outlet pipe 28 is best seen. A flange 18' is provided on the outer end of outlet 18 and a similar flange 28' provided on the mating end of the pipe 28, joining or coupling rings 30, of a size slightly larger than the external circumference of outlet 18 and pipe 28 are provided with appropriate apertures therein for reception of a series of clamping bolts 32 with nuts 34 thereon. As is obvious, by tightening the nuts 34 on the bolts 32, the annular rings 30 will be drawn together and secure the flanges 18' and 28' against each other. An appropriate gasket 35 normally will be provided between the coupling flanges.

An important feature of this invention is in the multiple tangential inputs, best seen in cross section in FIG. 4. The inlets 20 have central apertures 23 therein which feed tangentially into the interior of the vessel 12. Replaceable and changeable in size, coupling structure 21 are provided for coupling the inlet openings to the input feed ells 22. The coupling structure 21 may be varied in internal flow path by the tapered interiors 28 for changing and varying the input pressure of the slurry feed passing therethrough. The ends of the coupling structure 21 and the inputs 20 have mating flange portions 26' and 20' which are held together by coupling rings 30' and tightening and adjustment bolts 32' with nuts 34' thereon. Again, a suitable gasket 35' is provided between the mating surfaces. While only one of the coupling structure 21 is completely labelled in FIG. 4, obviously both coupling structure 21 shown are similar; and if three or four inputs were provided, similar coupling structure 21 for all would be used.

Connected between the input ell 22 and the coupling structure 21 is a gauge mounting plate 41. This gauge mounting plate is suitably coupled, by pressure coupling 42, to a pressure gauge 43. Coupling flanges 22" and 26" together with gaskets 35" are held together by bolts 32" with suitable nuts 34" thereon. Again, the ell 22 and feed pipe 24 are coupled by suitable flange portions 22' and 24', best seen in FIG. 1. Thus, from the structure described so far, one can visualize how the input feed pressures may be readily checked by means of the pressure gauges 43 and suitably adjusted by input valves, not shown, in the supply pipes 24. Also, if a permanent change in pressure or flow is desired, then the coupling structure 21 may be changed for ones having a different configured inlet channel 28 therewithin.

Looking at FIGS. 1 and 2, the removable top with tubular pipe member and splash shield will now be described in detail. The upwardly extending tubular pipe member 14 attached to the top 15 by welding or the like contains therewithin an adjustable atmospheric pipe 47 having an upper outer circumferential flange portion 48. Height adjustment rings 49*a*, 49*b* and 49*c* are provided for changing the relative heighth of the atmospheric pipe. Obviously, the heighth and diameter of said pipe may be varied as desired. By increasing in number the height adjustment rings 49, or changing the relative width thereof, the position of the lower end of the atmospheric pipe 47, as protruding into the vessel 12 interior chamber, may be varied as indicated by the dotted lines in FIG. 2. This pipe arrangement will prevent slurry particles from being splashed out of the vessel. A splash shield 45 is also provided depending from the inside of the top 15. An appropriate gasket member 50 may also be provided.

The vortex finder 54, as seen in perspective in FIG. 7 and as installed in FIG. 2, has an outwardly extending flange portion 56 at the mid-circumference thereof. This flange rests upon the circumferential ledge 52 provided internally of the vessel 12. A gasket member 51 is also provided between the flange portion 56 and the ledge 52. Adjustable holddown rods 70, preferably at least three in number, will secure the vortex finder within the vessel. An adjustment is provided for each of said rods 70 by means of the threaded portion 72 which complements with a mated portion 73 in the top 15. The portion 73 is obviously tapped or screw threaded to complement those of portion 72. A suitable wrench engaging portion 74 permits accurate adjustment of the holddown rods 70 and lock nuts 76 will retain the adjustment of same.

The top itself is provided with quick attach-detach clamp members which comprise hand levers 60 pivoted by means of pivot pins 61 through upright standards 62 provided at at least three points on the upper surface of the top 15. Each of these structures has another pivot pin 63 which is offset from the pivot pin 61 for pivotally supporting thereon the hook member 64. Thus, the clamps, using the well known type over-center pivotal action effect, can be used to positively clamp and hold the top 15 on the open top of the vessel, and then when it is desired to make any adjustment to the interior of the vessel, the clamps may be quickly loosened and the top removed.

The apex cone may be seen in perspective in FIG. 6. This cone is also shown in cross section as installed in FIG. 2. The apex cone comprises a main body member 80 of tubular construction having an internal aperture 81 and an extending circumferential flange portion 82. Interior of the portion 82 is conical as at 84 and connects with the aperture 81 by means of a central opening 83. The cone angle may be 60°, 75° or other suitable angles, and the apex cone may be changed to put the desired angle of cone inside the hydrocyclone vessel. The vessel itself has a lower bottom opening 90 and a recessed portion 92 adjacent thereto for reception of the apex cone 80. Directly adjacent the recess 92, and on the inner bottom portion of the vessel 12, is another larger shallow recess 94 for reception of a wear plate or ring 96. This ring 96 closely fits the outer circumference of portion 82 and substantially covers the bottom portion of the vessel. A curved portion 93 of gradual radius connects the flat bottom and the wear plate 96 as installed with the walls of the interior of the vessel.

Thus, from the above description, one can easily visualize how quickly and easily the apex cone 80 and the vortex finder 54 may be replaced by merely detaching the top 15. Also, how the inlet pressure and flow may be varied by changing the feed inserts 26.

Devices of this construction have been designed to handle 300 gallons per minute and up to 10 to 12 tons per hour. This will be with inlet slurries having approximately 15% solids and with materials or particles having a prior classification passing a 28 mesh. Suitable inlet pressure to the dual inlets of 8 to 10 pounds per square inch has been found to be quite satisfactory in actual practice. With a number of these units connected in a series arrangement, and appropriate shut off valves thereto and therefrom the individual units may be worked upon one at a time without interruption of the overall system. This device has been found to be very suitable for use in the separation of coal particles from undesired waste particles.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hydrocyclone including a vessel defining a generally cylindrical interior having upper and lower ends, said vessel including a bottom closing the lower end of said interior and defining a central outlet opening formed therethrough, fluid inlet means opening tangentially into said interior intermediate said upper and lower ends, an upwardly facing inwardly projecting annular abutment surface extending about said interior above said inlet means, and an outlet opening laterally outwardly of said interior above said abutment surface and below said upper end, a hollow cylindrical vortex finder including an outwardly projecting circumferential shoulder extending thereabout intermediate its opposite ends, said vortex finder and shoulder being loosely telescoped down into and readily removable upwardly through the upper end of said interior, said vortex finder being substantially centered in said interior and having the undersurface of said shoulder overlying and supported from said abutment surface for stationary support of said vortex finder within said interior, a top readily removably secured over and closing the upper end of said interior, said top having an upstanding central tubular pipe member attached thereto, said top further including a plurality of elongated abutments dependently supported from peripherally spaced portions of said top and spaced about said tubular pipe member pipe, said abutments projecting downwardly into said interior about said vortex finder and having lower end portions downwardly abutted against said shoulder to maintain the latter and thus said vortex finder in position against shifting relative to said abutment and vessel.

2. The structure as set forth in claim 1, wherein the opening in the bottom of the vessel includes replaceable outlet cone means.

3. The structure as set forth in claim 2, wherein the replaceable outlet cone means consist of a tubular member having a tapered cylindrical input at the upper end thereof.

4. The structure as set forth in claim 2, wherein the replaceable outlet cone has an associated wear plate arranged annularly adjacent thereto for preventing wear of the bottom of the vessel.

5. The structure of claim 1, wherein the inlet means includes at least two horizontal input openings arranged tangentially of said interior and connected with a slurry source by means of replaceable and pressure restricting feed inlet pipes.

6. The combination of claim 1 wherein said abutments comprise threaded members threadedly supported from said top for threaded shifting relative thereto.

7. The combination of claim 1 wherein the opening in the bottom of the vessel includes replaceable outlet cone means for changing the selection of particles to permit it to pass outwardly of said central outlet opening, said outlet cone means being upwardly displaceable from said central outlet opening, through said angular abutment surface and outwardly through the upper end of said interior when said top and vortex finder are removed.

8. The combination of claim 1 including a vertically adjustable, concentric, atmospheric pipe mounted within said tubular pipe member, said pipe member and said atmospheric pipe including coacting means operative to effect longitudinal shifting of said atmospheric pipe relative to said top and said tubular pipe member.

* * * * *